US009217252B2

(12) United States Patent
Meyer

(10) Patent No.: US 9,217,252 B2
(45) **Date of Patent: *Dec. 22, 2015**

(54) AIRGRATE FLOOR PANEL SUB-PLENUM RETROFIT AIRFOIL

(71) Applicant: Gary Meyer, Berthoud, CO (US)

(72) Inventor: Gary Meyer, Berthoud, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/538,515

(22) Filed: Nov. 11, 2014

(65) Prior Publication Data

US 2015/0128515 A1 May 14, 2015

Related U.S. Application Data

(60) Provisional application No. 61/902,864, filed on Nov. 12, 2013.

(51) Int. Cl.

| | |
|---|---|
| ***E04B 1/70*** | (2006.01) |
| ***E04F 15/024*** | (2006.01) |
| ***E04B 5/48*** | (2006.01) |

(52) U.S. Cl.

CPC ..... *E04F 15/02458* (2013.01); *E04B 5/48* (2013.01); *E04F 15/02405* (2013.01); *E04F 15/02452* (2013.01)

(58) Field of Classification Search

CPC ..... H05K 7/20745; H05K 7/20836; E04F 15/02458

USPC ..... 52/302.3, 220.8, 220.1, 220.2

See application file for complete search history.

(56) References Cited

U.S. PATENT DOCUMENTS

| | | | | |
|---|---|---|---|---|
| 3,391,629 | A * | 7/1968 | Snell | 454/290 |
| 4,566,243 | A * | 1/1986 | Dahlin | 52/578 |
| 4,901,490 | A * | 2/1990 | Zinniel et al. | 52/263 |
| 4,922,670 | A * | 5/1990 | Naka et al. | 52/126.6 |
| D567,398 | S * | 4/2008 | Meyer | D25/156 |
| D636,099 | S * | 4/2011 | Curtin et al. | D25/156 |
| 8,511,022 | B2 * | 8/2013 | Curtin et al. | 52/302.1 |
| 8,641,492 | B2 * | 2/2014 | Meyer | 454/184 |
| 8,733,060 | B2 * | 5/2014 | Curtin et al. | 52/664 |
| 2008/0274685 | A1 * | 11/2008 | DeJonge et al. | 454/241 |
| 2009/0241454 | A1 * | 10/2009 | Yeh et al. | 52/473 |

* cited by examiner

*Primary Examiner* — Basil Katcheves

(74) *Attorney, Agent, or Firm* — Scott L. Terrell, P.C.; Scott L. Terrell

(57) ABSTRACT

A retrofit airfoil for attachment to at least one of the girder members of an open-box load bearing frame supporting an air-grate raised access floor panel is provided. The open box flame includes a plurality of longitudinally spaced apart vertical girder-plate members and a plurality of longitudinally spaced apart transverse vertical reinforcing rib-plate members. The airfoil includes a sheet. The sheet has an upper edge, a lower edge, and a horizontal bend formation positioned along a longitudinal axis established therebetween. The bend formation defines an upper vertical face, and a lower inclined face. The upper vertical face includes a plurality of tongue and groove formations adapted for interlocking fitment with the vertically extending transverse reinforcing rib-plate members, so that the sheet is capable of being slidably attached to at least one of the girder members with the upper edge being positioned adjacent to the lower surface of the top plate. The vertical face of the sheet also includes at least one retainer to secure the vertical face of the sheet to the girder member.

9 Claims, 7 Drawing Sheets

AIRGRATE FLOOR PANEL SUB-PLENUM RETROFIT AIRFOIL

CROSS REFERENCE TO RELATED APPLICATIONS

Pursuant to 35 U.S.C. 119 (e), Applicant claims the benefit to the 35 U.S.C. 111(b) Ser. No. 61/902,864, Provisional Application, filed Nov. 12, 2013.

STATEMENT OF FEDERALLY SPONSORED RESEARCH

Not Applicable.

BACKGROUND OF THE INVENTION

1. Field of the Invention

The present invention relates to raised access floor panels. In particular, it relates to an interlocking directional airfoil for attachment to a vertical plate member of an open-box support frame for an air-grate raised access floor panel.

2. Description of the Related Art

Raised floor systems are used in data centers to create a sub-plenum space between the sub-floor, of a building, and the normal operating environment of the computer room. The sub plenum space is used for circulating cooling air to the computer servers. Perforations in the top plates, of air-grate floor panels, are configured to enhance the circulation of cooling air through the raised floor. Air-grate floor panels use an open-box load bearing frame. The open-box frame is designed with longitudinally spaced apart vertical girder plates, and transverse vertical reinforcing rib plates, in a crisscrossed assembly, for supporting the load.

Manufactures of raised floor panels have engaged in the redesigned and development of the open box sub-frame to inchide girder plates which are configured with a lower flanged face, which acts to redirect a tangential cooling air-flow, originating in the sub plenum, upwardly through the open air-grate perforations in the top plate with an object of enhancing cooling efficiency to the server cabinets. One such design, which has gained wide acceptance in the industry, is the open box sub-frame disclosed in U.S. Pat. Ser. No D567, 398, to Meyer. There it is ordinarily observed that the supporting girder plates, of the open box sub-frame, include lower inclined airfoils that are capable of capture and redirection of a tangential flow of cooling air. It can be appreciated that a fluid dynamic, inherent in use of this design, would result in an increase in the volume and directional velocity of the cooling air flowing from the sub-plenum and into the upper plenum, of a computer room, through the slotted perforations in the air-grate floor panel top plate. This increase in velocity enhances cooling efficiency, and further promotes the creation of an air separation barrier within the computer room.

While the foregoing design offers utility in enhancing the cooling efficiency of the computer servers, in a data center, because the air-foil girder members are integral to the sub-frame assembly, in use, one is required to retro-fit a portion of an existing raised floor with one or more floor panels in order to realize the improved cooling efficiency, inherent with foregoing design. Thus, what is needed is a pressed fit interlocking airfoil which is attachable to the girder members of an open box sub-frame assembly of an air-grate raised floor panel. The present invention satisfies these needs.

BRIEF SUMMARY OF THE INVENTION

It is therefore an object of the present invention to provide a pressed fit interlocking airfoil which is attachable to the girder members of an open box sub-frame assembly of an air-grate raised floor panel It is another object of the present invention to provide a sub-plenum directional air-foil capable of enhancing the cooling efficiency in a data center.

To overcome problems associated with the prior art, and in accordance with the purpose(s) of the present invention, briefly, an interlocking airfoil for pressed fit attachment to at least one of the girder members of an open-box load bearing frame supporting an air-grate raised access floor panel, is provided. The open-box frame includes a plurality of longitudinally spaced apart vertical girder-plate members and a plurality of longitudinally spaced apart transverse vertical reinforcing rib-plate members. The interlocking airfoil includes a sheet. The sheet has an upper edge, a lower edge, and a horizontal bend formation positioned along a longitudinal axis established therebetween. The bend formation defines an upper vertical face, and a lower inclined face. The upper vertical face includes a plurality of tongue and groove formations, adapted for interlocking fitment with the vertically extending transverse reinforcing rib-plate members, so that the sheet is capable of being slidably attached to at least one of the girder members with the upper edge being positioned adjacent to the lower surface of the top plate. The vertical face, of the sheet, also includes at least one clip retainer to secure the vertical face to the girder member.

Additional advantages of the present invention will be set forth in the description that follows, and in part will be obvious from that description or can be learned or appreciated from practice of the invention. Moreover, the advantages of the invention can be realized and obtained by the invention as more particularly pointed out in the appended claims.

BRIEF DESCRIPTION OF THE SEVERAL VIEWS OF THE DRAWINGS

The accompanying drawings, which are incorporated in and which constitute a part of the specification, illustrate at least one embodiment of the invention and, together with the description, explain the principles of the invention through illustration to persons of skill in the art.

DETAILED DESCRIPTION OF THE DRAWINGS

Figure 1:
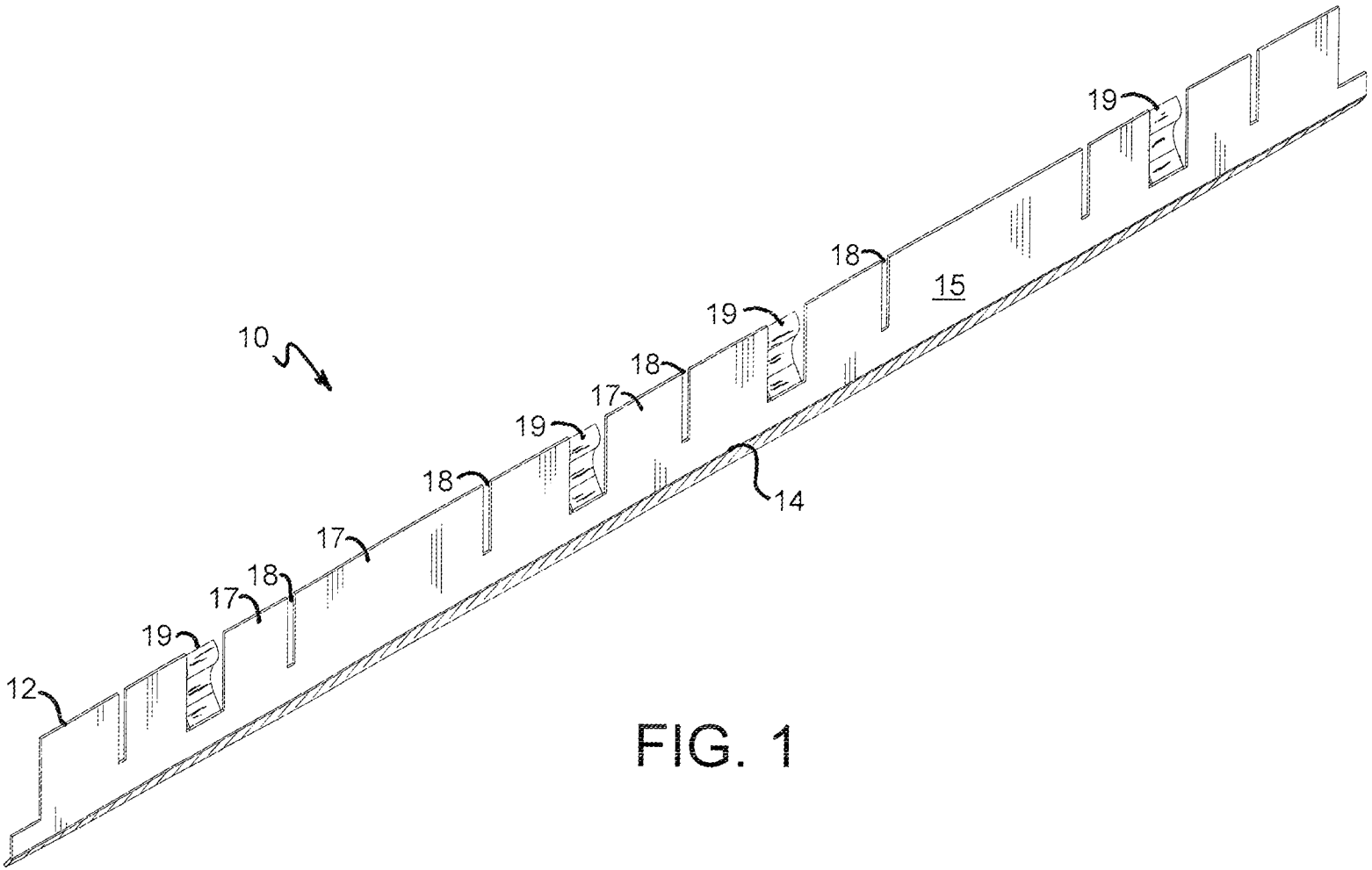
FIG. 1 is an isometric front view of the interlocking airfoil.
Figure 2:
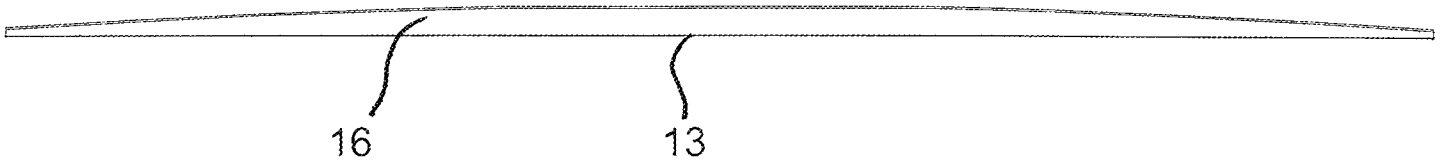
FIG. 2 is a bottom view of the interlocking airfoil.
Figure 3:
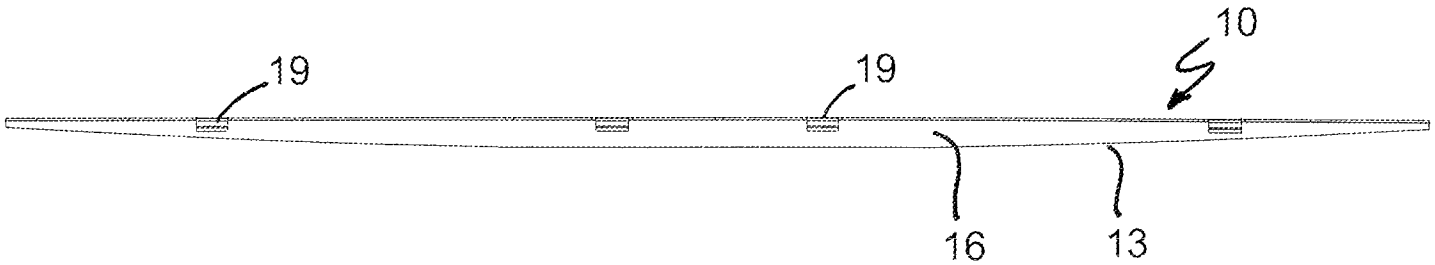
FIG. 3 is a top view of the interlocking airfoil.
Figure 4:
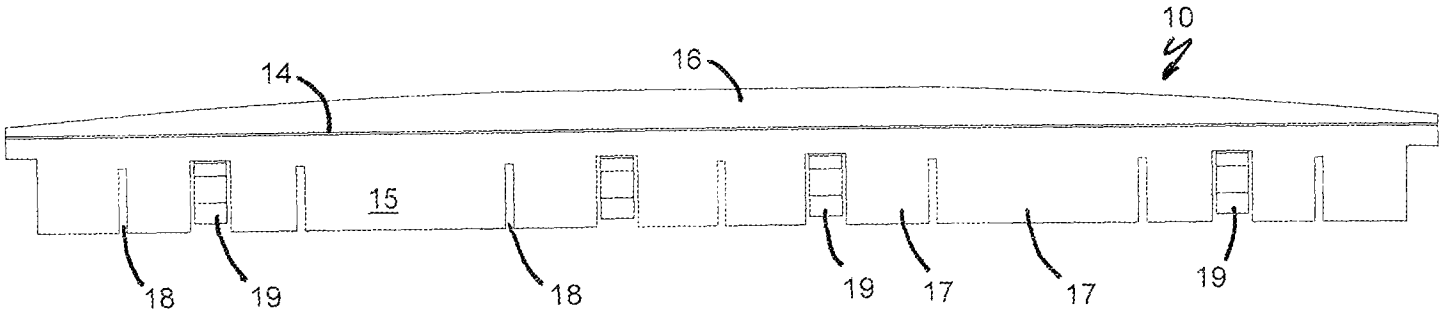
FIG. 4 is a front view of the interlocking airfoil.
Figure 5:
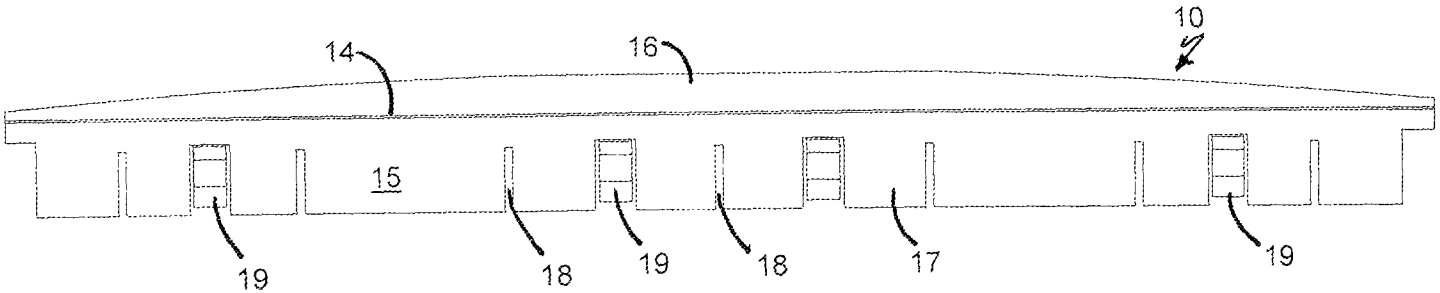
FIG. 5 is a back view of the interlocking airfoil.

Unless specifically defined otherwise, all scientific and technical terms, used herein, have the same ordinary meaning as would be commonly understood by one of ordinary skill in the art to which this invention belongs.

The term "sub plenum" means that portion of the computer room below the air-grate floor panels when installed on a pedestal support system. The term "upper plenum" means that portion of the computer room above the air-grate floor panels, including the data processing server equipment and in-row air conditioners, or air handling units. Thus, the term "computer room" means the overall air handling environment including the upper and sub plenums from the subfloor to ceiling. Finally, "CRAC units" means those computer room an conditioning units typically located at the perimeter of the data center floor surrounding the (server) racks, or in-rows to circulate air in the data center space to create a cooling loop.

In practice, the present invention improves the capture of sub-plenum cooling air, supplied via in-row CRAC units, and redirects the captured cooling air upwardly through the top plate of the raised floor air-grate to enhance cooling efficiency to the computer servers in the upper plenum of the computer room.

Although any methods and materials similar or equivalent to those described herein, can be used in the practice or testing of the present invention, the preferred methods and materials are now described. Reference will now be made in detail, to the presently preferred embodiments of the invention, including the examples of which are illustrated in the accompanying drawings. In the drawings, like numerals will be used in order to represent like features of the present invention.

The present invention provides a sub-plenum interlocking airfoil 10 for pressed fit attachment to at least one of the girder plate members 22 of an open-box load bearing frame 20 supporting an air-grate raised access floor panel. The open box frame 20 includes a plurality of longitudinally spaced apart vertical girder-plate members 22 and a plurality of longitudinally spaced apart transverse vertical reinforcing rib-plate members 24. The interlocking airfoil 10 includes a sheet. The sheet has an upper edge 12, a lower edge 13, and a horizontal bend formation 14 demarcated along a longitudinal axis established therebetween. The bend formation 14 defines an upper vertical face 15, and a lower inclined face 16. The upper vertical face 15 includes a plurality of tongue 17 and groove 18 formations adapted for interlocking fitment with the vertically extending transverse reinforcing rib-plate members 24, so that the sheet is capable of being slidably attached to at least one of the girder members 22 with the upper edge 12 being positioned adjacent to the lower surface 31, of the top plate 30. The vertical face 15 of the sheet also includes at least one clip retainer 19 to secure the vertical face 15 of the sheet to the girder member 22. The sheet of the interlocking airfoil 10 is desirably formed as a molded polymer, or is tooled from a blank sheet or plate of metal stock.

Figure 6:
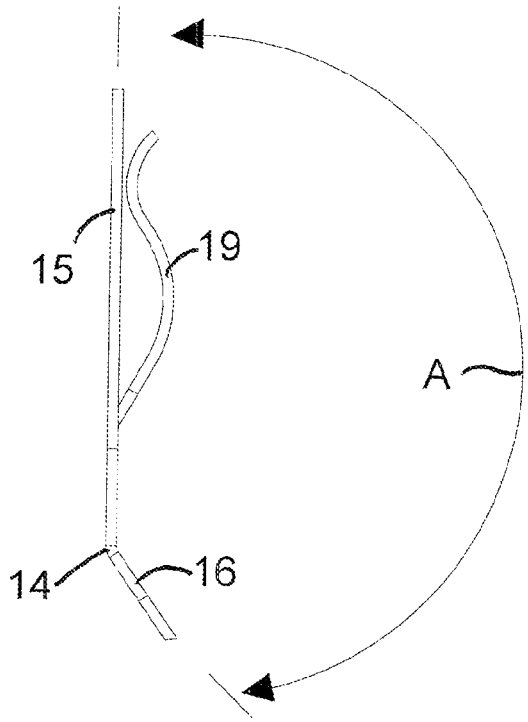
FIG. 6 is a right side view of the interlocking airfoil.
Figure 7:
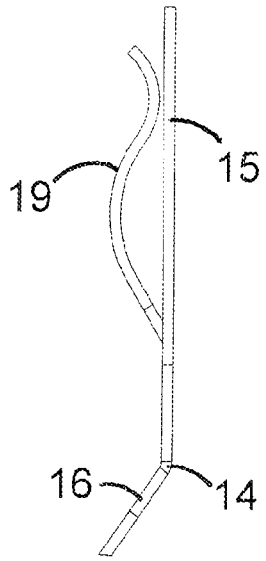
FIG. 7 is a left side view of the interlocking airfoil.
Figure 8:
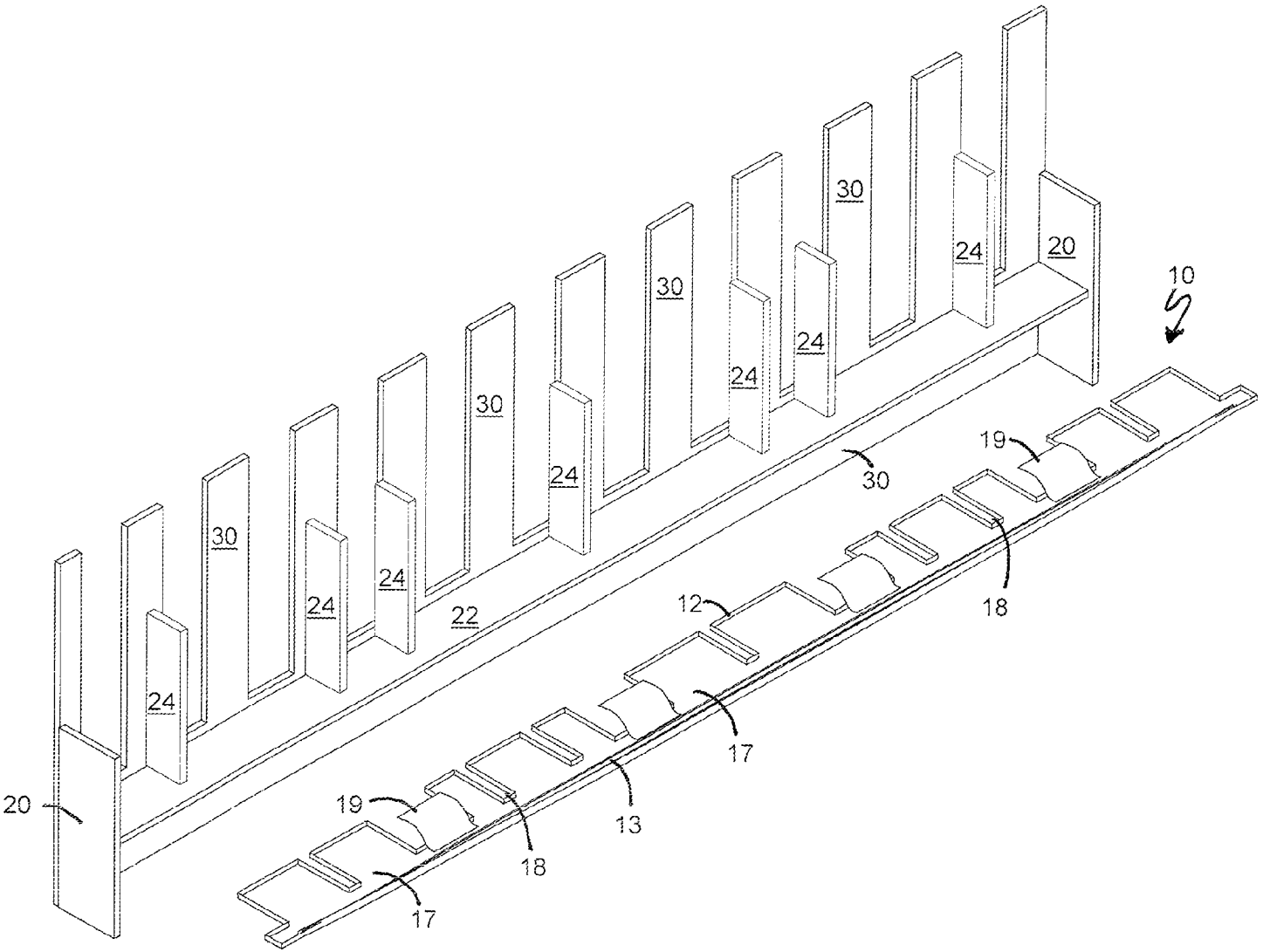
FIG. 8 is an isometric view of the interlocking airfoil for pressed fit attachment to a girder member of the open-box load bearing.
Figure 9:
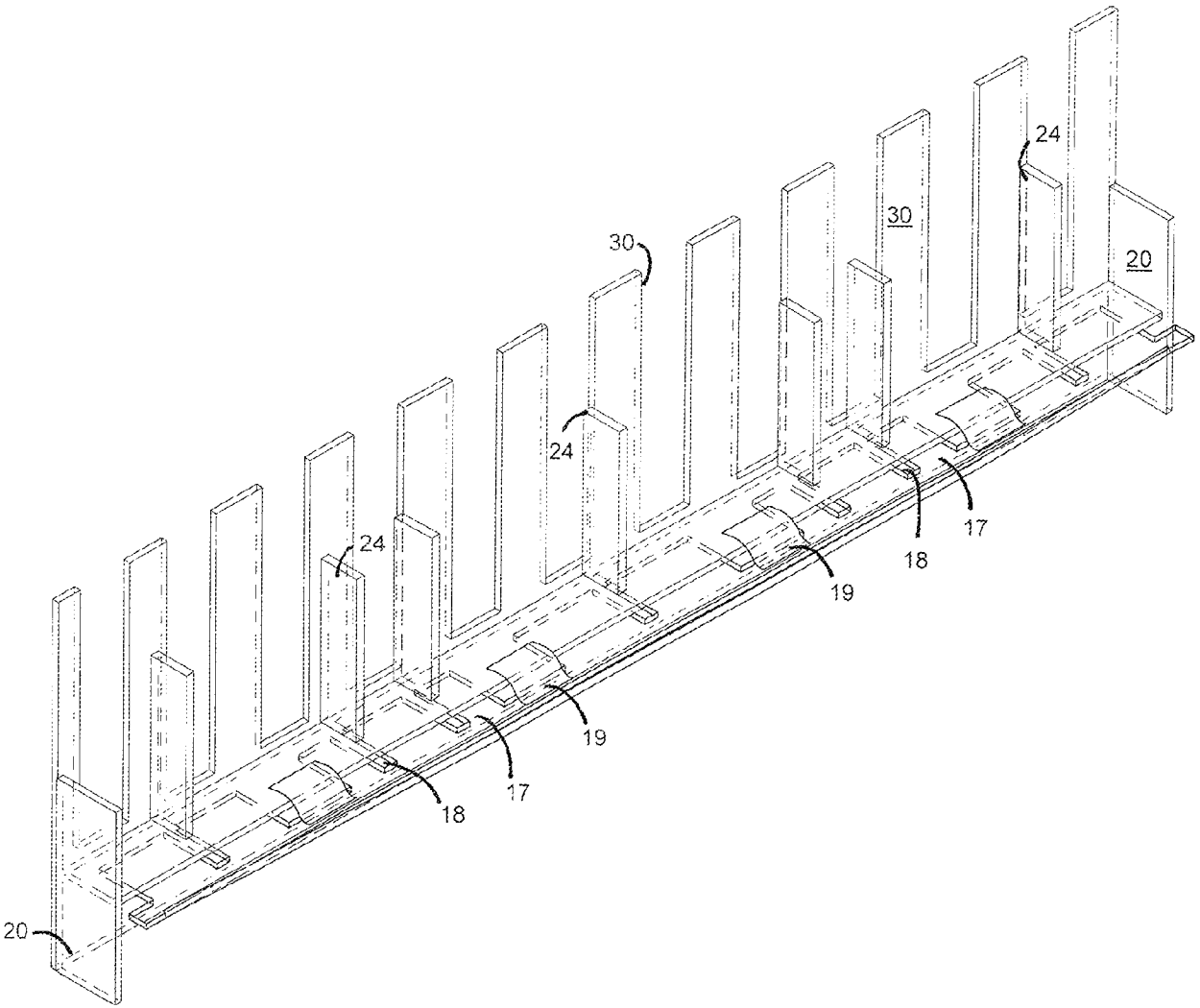
FIG. 9 is an isometric dashed hidden line view of the interlocking airfoil in pressed fitment to a girder member of the open-box load bearing frame.

Referring now to FIGS. 6 and 7, the clip retainer 19 is desirably formed as a sheet spring member, having a generally S-shaped cross sectional profile, adapted to fixedly bias against a side wall of the girder plate member 22. In another embodiment, the clip retainer may, but need not, be formed as a flat sheet and having a series of longitudinally spaced apart clear holes adapted for receiving a plurality of retaining fasteners for use with a girder vertical plate which also include a series of drilled clear holes therethrough, in a complimentary alignment, for receiving the fasteners. With this embodiment, the fasteners may be of any type well known in the art in forming a lap seam connection, such as removable press-fit pin clip connectors, rivets, or threaded fasteners such as a screw or bolt.

With the presently preferred embodiment, the bend formation 14 defines an obtuse angle A which is substantially 145 degrees to vertical. The angle is not merely a design element, but has been empirically determined to be functional in its utility in directing a tangential airflow, originating in the sub-plenum so that the cooling air is redirected angularly and upwardly to efficiently impact a computer server rack air intake door. The sheet is also empirically and desirably 1.75× 21.2 inches. The bend formation 14 is desirably made 0.75 inch from the upper edge 12.

Figure 10:
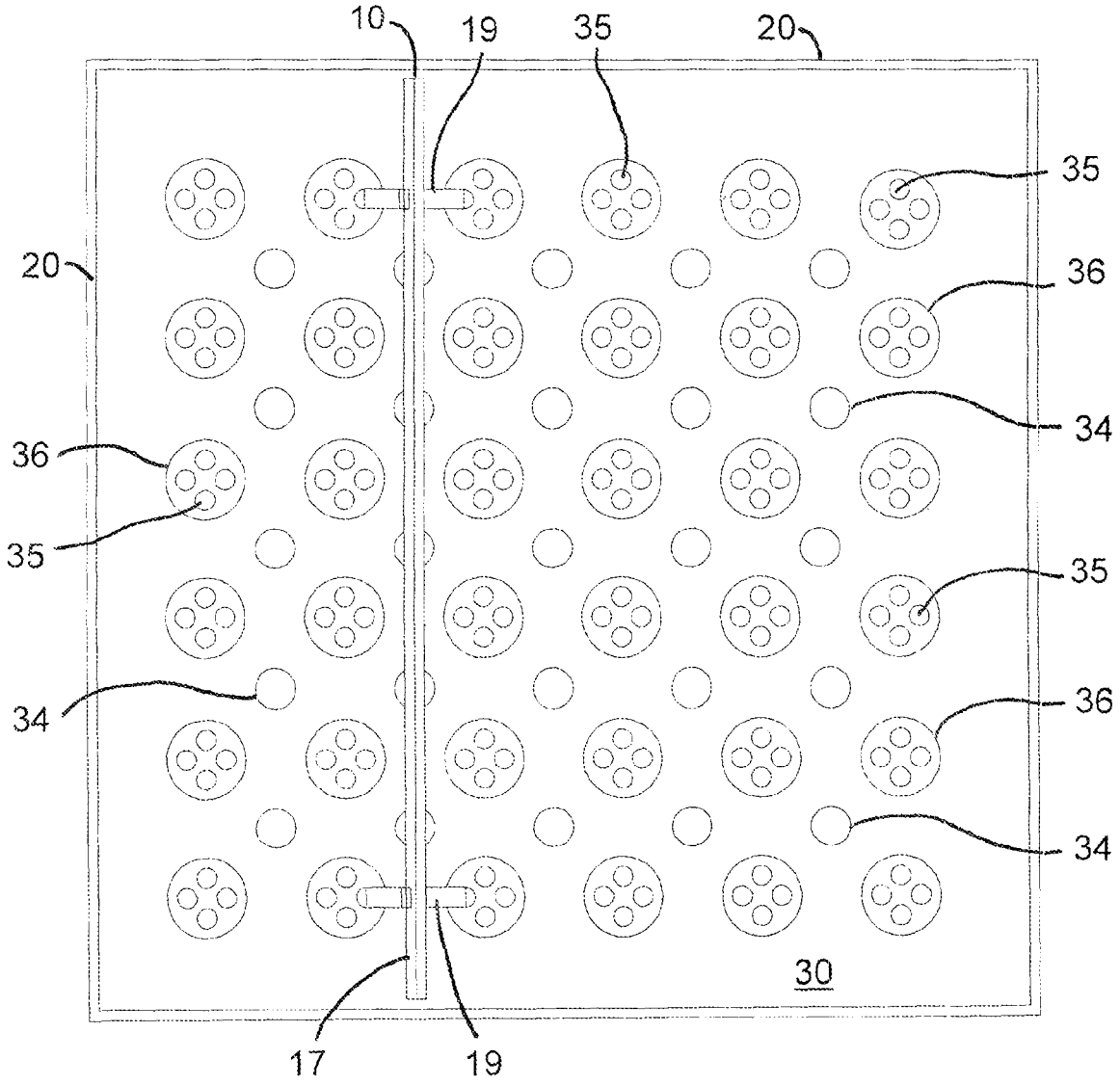
FIG. 10 is bottom side view of the present invention attached to the sub-frame of a hemispherical chambered air-grate.

Referring now to FIG. 10, the present invention is broadly disclosed as a retrofit airfoil which is capable of modification for attachment to any sub-frame assembly. For example, in FIG. 10, a bottom view of a sub-frame assembly is shown where the sub-frame assembly is configured with columns of concave hemispherical airflow chambers 36. The hemispherical air chambers 36 include clear holes 35 which serve to channel the cooling air flow, for circulation, from the sub-plenum, through the air-grate top plate 30, and into the upper-plenum. Between the columns of hemispherical air chambers 36 are transverse ribs being formed with convex dimple formations 34, which, for purposes of the present disclosure, are structurally analogous to the supporting rib members 24, described above. Here, in use, the retaining clips 19 are snap fit into the clear holes 35 to secure the interlocking airfoil 10 to the transverse rib and dimple formations 34 of the sub-frame. In yet another embodiment of the clip retainer, with this embodiment the clip retainer includes a distal end having a hook or bead formation being capable of being received in, and securing the clip retainer in the airflow clear hole 35 formed in a convex hemispherical airflow chamber 36.

While, the present invention has been described in connection with the preferred and illustrated embodiments, it will be appreciated and is understood that certain modifications may be made to the present invention without departing from the true spirit and scope of the invention.

I claim:

1. A combination air grate and interlocking airfoil for a raised floor system, the air grate having a top plate supported on an open box load bearing frame, the frame connected to a lower surface of the top plate, the open box frame including a plurality of longitudinally spaced apart vertical girder members and a plurality of longitudinally spaced apart transverse vertical reinforcing rib plate members, the interlocking airfoil for pressed fit attachment to a girder member of an air grate floor panel, comprising: a sheet having an upper edge, a lower edge, and a horizontal bend formation positioned along a longitudinal axis therebetween, said bend formation defining an upper vertical face, and a lower inclined face, wherein said upper vertical face includes a tongue and groove formation, said formation being adapted for interlocking fitment with a vertically extending reinforcing rib-plate member of said air grate so that said sheet is capable of being slidably attached to said girder member, and wherein said vertical face further includes at least one clip retainer to secure said vertical face of said sheet to said girder member.

2. The combination according to claim 1, wherein said girder member is a vertical plate.

3. The combination according to claim 2, wherein said clip retainer is a sheet spring member having a generally S-shaped cross sectional profile adapted to fixedly bias against a side wall of said vertical plate.

4. The combination according to claim 2, wherein said clip retainer is a flat sheet having a series of longitudinally spaced apart clear holes adapted for receiving a plurality of retaining fasteners and said vertical plate include a series of drilled clear holes in a complimentary alignment for receiving said fasteners.

5. The combination according to claim 4, wherein said fasteners are removable press-fit pin clip connectors.

6. The combination according to claim 4, wherein said fasteners are a rivet.

7. The combination according to claim 4, wherein said fasteners are a threaded fastener being a screw or bolt.

8. The combination according to claim 1, wherein said girder members comprises a series of spaced apart convex dimple formations, and whereby said tongue formation is a convex hemispherical surface of said dimple formation, and said groove formation is a portion between each of said dimple formations.

9. The combination according to claim 8, wherein said clip retainer includes a distal end having a hook formation being capable of being received in and securing said clip retainer in a clear hole formed is a convex hemispherical airflow chamber.

* * * * *